US007867342B1

(12) United States Patent
Provencio

(10) Patent No.: US 7,867,342 B1
(45) Date of Patent: Jan. 11, 2011

(54) CYMBAL CLEANING DEVICE

(76) Inventor: Eugene Provencio, 12946 Valleyheart Dr., No. 214, Studio City, CA (US) 91604

( * ) Notice: Subject to any disclaimer, the term of this patent is extended or adjusted under 35 U.S.C. 154(b) by 270 days.

(21) Appl. No.: 11/860,359

(22) Filed: Sep. 24, 2007

(51) Int. Cl.
*B08B 3/00* (2006.01)

(52) U.S. Cl. ..... 134/56 R; 15/97.1; 451/67

(58) Field of Classification Search ..... 134/56 R, 134/59, 201
See application file for complete search history.

(56) References Cited

U.S. PATENT DOCUMENTS 3,640,029 A * 2/1972 Zildjian ..... 451/53
4,332,542 A 6/1982 Matsui
4,526,083 A * 7/1985 LeMert ..... 84/421
5,230,909 A 7/1993 Stanly
5,729,856 A 3/1998 Jang
7,114,933 B2 10/2006 Adachi
2003/0215538 A1* 11/2003 Oakes ..... 425/263
2006/0070641 A1* 4/2006 Kim ..... 134/184

* cited by examiner

*Primary Examiner*—Michael Kornakov
*Assistant Examiner*—Eric Golightly
(74) *Attorney, Agent, or Firm*—Tsircou Law, P.C.

(57) ABSTRACT

A method and device for cleaning cymbals in which a cymbal is secured to a rotatable device, the rotatable device is rotated, and a cleaning agent is applied to the rotating cymbal after which an abrasive member is translated radially over the surface of the rotating cymbal thereby cleaning the cymbal. The device for cleaning a cymbal has a housing and a rotatable motor therein. The motor has an upstanding threaded shaft onto which a cymbal is secured with a cooperating threaded fastener. A regulator controls the speed of rotation. As the cymbal rotates within the housing, the cleaning agent is applied and an abrasive member is translated radially over the surface of the rotating cymbal.

11 Claims, 2 Drawing Sheets

CYMBAL CLEANING DEVICE

CROSS REFERENCES TO RELATED APPLICATIONS

None.

STATEMENT REGARDING FEDERALLY-SPONSORED RESEARCH OR DEVELOPMENT

None.

BACKGROUND

This method and device of the present disclosure relates to an improvement in cleaning musical instruments, and more particularly to a method and device to make cleaning cymbals easy, fast, and a relative clean process without making an additional mess which itself requires cleaning.

The cymbal is a percussion music instrument used to generate sound. It typically consists of two thin, round, concave plates generally of copper-tin alloy. Cymbals also may have handles or other leather components attached to their backs.

Cymbals have been part of cultures for centuries. They have played a key role in both celebrations and marches to war. The modern orchestral cymbal is at least 14 inches in diameter. Cymbals are used to express part of the drum set vocal range. The sounds they make at certain places in a song will speak to the listener.

Sometimes a single cymbal may be suspended from a frame with a petal-actuated cymbal underneath. This is called a choke cymbal. The opposite of this is a sock cymbal, where the top is fixed and the bottom cymbal is moveable.

Sound is produced by clashing together the cymbals or striking them separately with hard or soft beaters. The cymbals are struck together with a brushing motion because clashing them directly together may cause them to crack. This produces a long-lasting loud or soft sound of indeterminate pitch. A cymbal suspended from a frame produces sound either by a petal-actuated cymbal or by metal brushes or a cloth-covered drumstick.

For the necessary sound and finish cymbals are generally made of combining two metals, copper and tin. Copper makes up the largest portion of most cymbals. Tin is the second most abundant alloy used. Typically, cymbals for beginners include about 8% tin and 92% copper while professional level cymbals have about 20% tin and 80% copper. Both beginner-quality and professional-quality cymbals can be made with various amounts of other materials. These include: zinc, nickel, manganese, aluminum, silver, gold, and phosphorus. The desired sound will dictate which metals and what amount of these other metals are used.

The 20% tin/80% copper mixture is called "Bell Bronze". This formula produces cymbals capable of great dynamic range. The 8% tin/92% copper blend is called "Malleable Bronze", which can be made into sheets and stamped into shape to reduce manufacturing costs. They are considered a great choice for beginners due to the cheaper price and the fact that they are less sensitive than bell bronze, which is easier to play for someone learning.

There are several basic techniques used in making most cymbals to create the desired sound and finish of each model. Some of these include [1] casting or stamping followed by [2] the refining process of hammering, lathing, and/or finishing.

Casting involves pouring hot liquid metal into a form that closely resembles the final dimensions. In stamping malleable alloys are required. These metal alloys are rolled into sheets where they are "stamped" by a machine into a likeness of the final cymbal form.

Hammering can be achieved by hand or by machine. Machines can be programmed for repeatable patterns or controlled by the cymbal maker. Hammering has several purposes for the cymbal. It is key for the bell bronze type since the form is less defined from the casting process. The shape is from the blows of a blunt hammer.

Lathing entails placing the cymbal on a rotatable machine which is then spun. While the cymbal is spinning, minute traces of metal are peeled from the surface. This process also produces the curvilinear scoring lines seen in cymbals.

Finishing involves applying a brilliant finish to the cymbal, a feature which has become more popular in recent years. This is done with an abrasive polish, adding metal plating, adding a lacquer, or any combination thereof to help prevent an oxide layer from forming.

Cymbals can be allowed to tarnish, with the formation of an oxide layer on the surface. Some musicians believe this was traditionally done to give the cymbal a more "mellow" sound with time.

Because of their composition and manner of use, cymbals will tarnish or become dirty or both and lose their luster and finish and may require cleaning. Dust, cigarette smoke, and oil from a person's fingers and hand will cause a cymbal to become dirty and, if not soon cleaned, will embed and harden making it more difficult to clean. Over time cymbals will turn green and otherwise tarnishing due to slow oxidation.

Cleaning this round relatively flat object is cumbersome. For a variety of reasons, be it sound or aesthetics or both, some musicians prefer to clean their cymbals while others do not. Musicians who clean their cymbals generally do so because of the bright and shiny appearance the cymbal presents, it shines brightly and looks good on-stage particularly with stage lights reflecting off the shiny cymbals. They also believe the sound quality is better in that the cymbal sounds as it should when manufactured. On the other hand, musicians who don't clean their cymbals generally do so because they like the way a tarnished green cymbal sounds; dark and earthy without a lot of overtones. Most musicians I have found prefer to clean their cymbals.

Cleaning agents used to clean cymbals include those sold by cymbal manufacturers, or other over-the-counter commercially available products such as Brasso®, Roadie-In-A-Bottle®, or Barkeepers Best Friend®, and the like. These are good for either a quick polishing of the cymbals or a deep cleaning due to build up of grime, oils, gunk, and dust. Comet® and Formula 409® are also good starters for removing heavy build-up of grime and gunk on cymbals followed by use of the cleaning agents listed above; but great care must be taken so as not to scratch the cymbal or cross-score it [scoring the cymbal against the grain of the original scoring lines] in the process.

Virtually all of these cleaning agents recommend to apply the cleaning agents with a soft, clean, dry rag on one small area at a time. If the cleaning agent is applied on too large of an area, the oldest polish may dry onto the cymbal and require much more "agitation" with the rag to remove it. The rag must be turned several times during this initial cleaning process so that a clean section is being regularly used and not a tarnished section. Once the entire cymbal surface is cleaned with the cleaning agent all the tarnish is typically removed. This is an extremely messy evolution.

To create the desired brilliant shine, the musician will repeat the process with a clean rag. This last phase is in reality the buffing phase and is easier than the first "cleaning" phase which removes the tarnish and grime built-up over time on the cymbals and in their scoring lines.

As mentioned, this entire process is time-consuming, cumbersome, and messy. If an abrasive agent is first required, the musician must be careful not to cross-score the scoring lines or to deeply scratch the cymbal as this would adversely affect its appearance and, to the purist, the sound quality. After the cleaning agent is applied, it should be wiped with the clean rag in the direction of the grooves [scoring lines] of the cymbal.

Because of all these difficulties some musicians send their cymbals to a professional cleaning entity to clean their cymbals. This process is rather expensive and, naturally, requires the musician to part with the cymbals for a period of time. Because of the high costs involved in a professional cleaning, some musicians either clean their cymbals themselves or don't clean them at all even though they may prefer the clean look and new-like sound of a clean and polished cymbal.

The method and device of the present disclosure makes cleaning one's cymbal easier, quicker, and cleaner and further eliminates the need for a professional cleaner and the expenses associated therewith. The final result is a clean cymbal bearing a brilliant lustrous shine and new-like sound. Speed, simplicity, cost, and outcome underscore the method and device of the present disclosure.

The foregoing has outlined some of the more pertinent objects of the method and device of the present disclosure. These objects should be construed to be merely illustrative of some of the more prominent features and applications of the method and device of the present disclosure. Many other beneficial results can be attained by applying the disclosed method and device of the present disclosure in a different manner or by modifying the method and device of the present disclosure within the scope of the disclosure. Accordingly, other objects and a fuller understanding of the method and device of the present disclosure may be had by referring to the summary of the method and device of the present disclosure and the detailed description of the preferred embodiment in addition to the scope of the method and device of the present disclosure defined by the claims taken in conjunction with the accompanying drawings.

SUMMARY

The above-noted problems, among others, are overcome by the method and device of the present disclosure. Briefly stated, the method and device of the present disclosure contemplates a method and device for cleaning cymbals.

The device has a housing and a rotatable motor therein. The motor has an upstanding threaded shaft onto which a cymbal is secured with a cooperating threaded fastener. The cymbal rests on the shaft in the housing and below the top edge of the housing. A regulator controls the speed of rotation. As the cymbal rotates within the housing, a cleaning agent is applied to the cymbal and an abrasive member is then translated radially over the surface of the rotating cymbal thereby cleaning the cymbal. The residue from the cleaning agent is removed with a clean dampened cloth as the cymbal continues to rotate.

The method of cleaning a cymbal requires the use of the device described above or any rotatable device or turntable adapted to receive and secure a cymbal thereto. The rotatable device is rotated, and a cleaning agent is applied to the rotating cymbal after which an abrasive member is translated radially over the surface of the rotating cymbal thereby cleaning the cymbal. The residue from the cleaning agent is then removed with a clean dampened cloth as the cymbal continues to rotate. The process is repeated as necessary to clean the cymbal to the desired degree.

The foregoing has outlined the more pertinent and important features of the method and device of the present disclosure in order that the detailed description that follows may be better understood so the present contributions to the art may be more fully appreciated. Additional features of the method and device of the present disclosure will be described hereinafter which form the subject of the claims. It should be appreciated by those skilled in the art that the conception and the disclosed specific embodiment may be readily utilized as a basis for modifying or designing other structures and methods for carrying out the same purposes of the method and device of the present disclosure. It also should be realized by those skilled in the art that such equivalent constructions and methods do not depart from the spirit and scope of the method and device of the present disclosure as set forth in the appended claims.

BRIEF DESCRIPTION OF THE DRAWINGS

For a fuller understanding of the nature and objects of the method and device of the present disclosure, reference should be had to the following detailed description taken in conjunction with the accompanying drawings in which.

DETAILED DESCRIPTION

Figure 1:
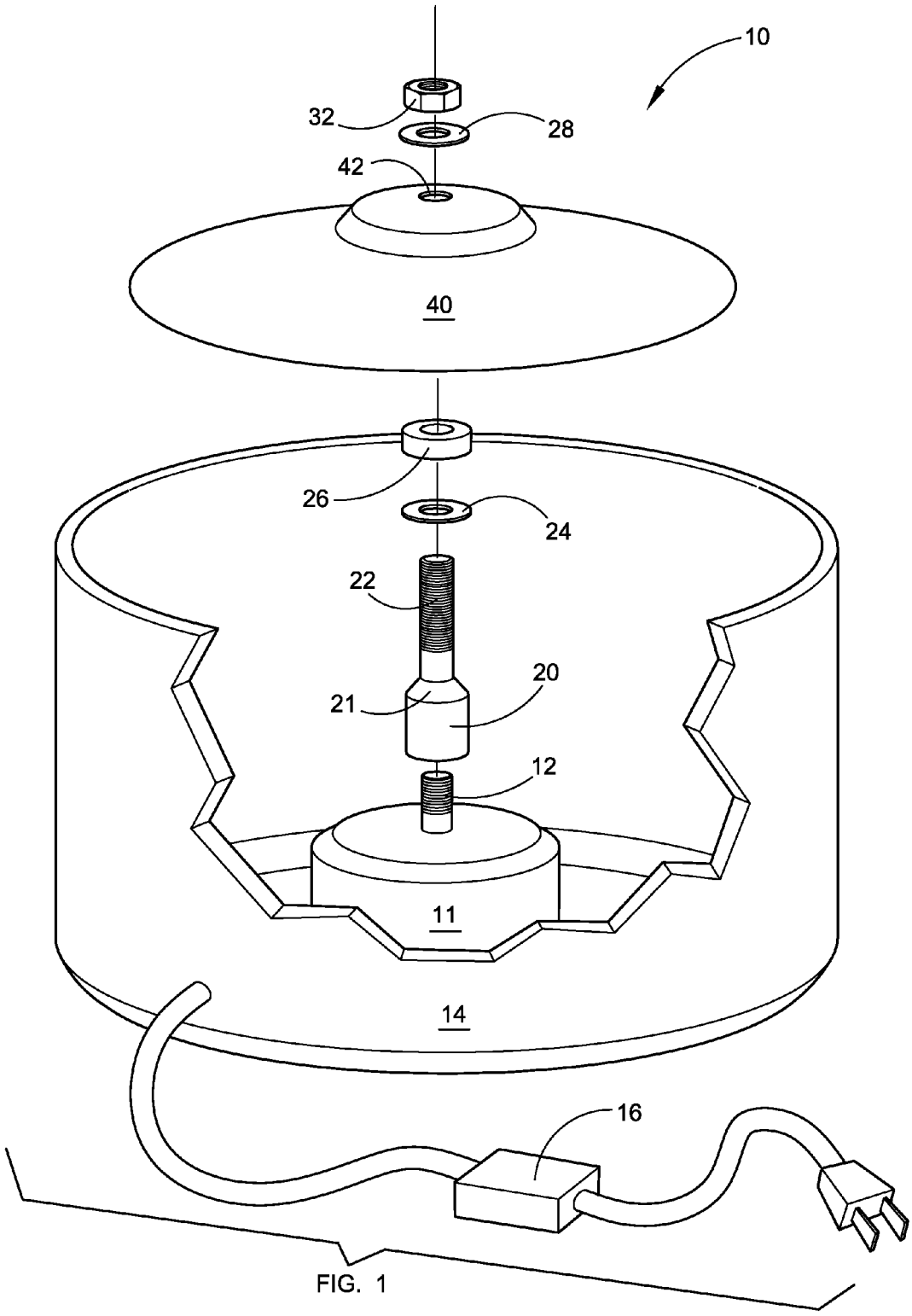
FIG. 1 is an exploded perspective view of the cymbal cleaning device.

Referring now to the drawings in detail and in particular to FIG. 1, reference character 10 generally designates a cymbal-cleaning device constructed in accordance with a preferred embodiment as set forth in the present disclosure and a method of cleaning the cymbals. FIG. 1, an exploded view, illustrates the cleaning device 10. An conventional electric motor 11 is within the housing 14.

The motor 11 has an upstanding shaft 12. The motor 11 derives power from an external conventional source [not shown]. A conventional regulator 16 is used to regulate the speed of rotation on the shaft 12 which will hold the cymbal 40 to be cleaned.

On the shaft 12 is a support member 20, with a beveled top 21 and a protruding upward standing threaded spindle 22. A first lower set member 24 [typically a metal washer] is seated onto the beveled top 21 of the support member 20 followed by a cushion-like seat member 26 [typically a rubber washer]. The lower set member 24 will provide stabilizing support for a cymbal 40 when placed onto the support member 20. The seat member 26 will protect the cymbal 40 from scratches or gouges and enable a tight fit of the cymbal 40 to the support member 20.

Next a cymbal 40 will be fitted onto the support member 20 followed by an upper set member 28 [typically a metal washer]. A second rubber-like seat [not shown] may also be placed between the upper set member 28 and the cymbal 40. The cymbal 40 is secured to the device 10 by a securing member 32 [typically a threaded nut which mates with and threads to the threaded spindle 22]. The securing member 32 is tightened sufficiently to secure the cymbal 40 to the device 10 such that the cymbal 40 is rigidly in place and will not rock or move vertically in either direction as it is spun and cleaned.

The cymbal 40 securely rests on the threaded spindle 22 and below the top edge of the housing 14. With the cymbal 40 below the top edge of the housing 14, during the cleaning operation any splattering of cleaning agents or residue will not breach the side walls of the housing 14, but will be captured on the inner wall surface, thereby preventing an additional mess beyond the cleaning device 10 which would otherwise require cleaning.

Figure 2:
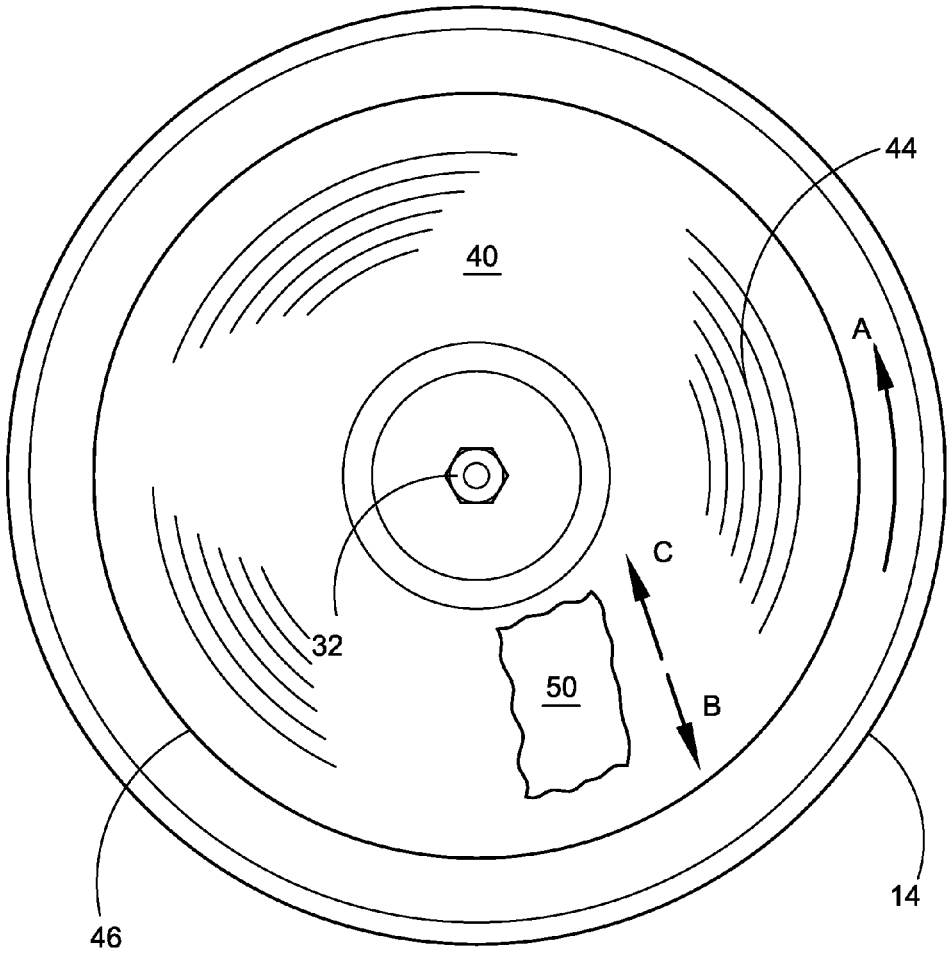
FIG. 2 is a top plan view of the cymbal cleaning device illustrating the method of cleaning.
Figure 3:
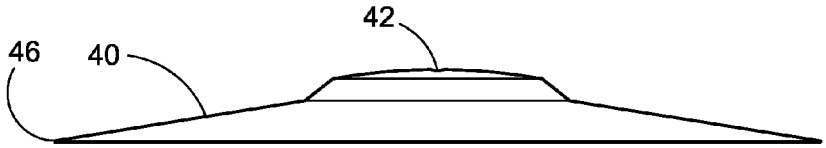
FIG. 3 is a side view of a typical cymbal.

With such placement and securement, the motor 11 is engaged and speed of rotation regulated suited to the user's needs and abilities. FIGS. 2 and 3 illustrate the cymbal 40, its basic characteristics, and the cleaning method. The cymbal 40 has a central aperture 42 and, due to its customary mode of manufacture and finishing, minute scoring lines or striations 44 from the lathing or refining process.

As the cymbal 40 is rotating in the direction of arrow A, a conventional cleaning agent, typically for metal products [not shown], such as Brasso®, Roadie-In-A-Bottle®, or Barkeepers Best Friend®, or similar cleaning agent, is poured in the direction of arrows B, C, on the rotating cymbal 40. It should be noted that these cleaning agents also serve as polishing agents after the surface upon which applied is cleaned of built-up grime, grease, and tarnish. It is best to use a water-based cleaning agent. This will facilitate removal of the spent cleaning agent and residue.

An abrasive member 50 [such as, but not limited to, a Scotch-Brite® type sponge or pad, steel wool, emery cloth, or a clean dry cloth], is then pressed to the surface of the cymbal 40 and the pad 50 is repeatedly but slowly moved back and forth from approximately the central axis/aperture 42 to approximately the outer edge 46 in the direction of arrows B, C. Although this movement is against the grain of the scoring lines 44, because the cymbal 40 is spinning, the abrasive cleaning activity of the slow back-and-forth movement is consistent with the scoring lines 46.

A notable change in appearance to the surface of the cymbal 40 will appear; i.e., it will blacken signifying the cymbal 40 is being cleaned. Grades of the abrasive member 50 should range generally from fine to extra fine; i.e., equivalent to 0 to 0000 of steel wool although a medium grade [-1-] may also suffice. Medium coarse [-2-] to extra coarse [-4-] may damage or excessively score the cymbal. Norton® brand steel wool, grade 000, works well in this process.

The next step in this process is to remove the blackened residue. This is done by using a clean rag or other cloth-like member [not illustrated] on the cymbal 40 as it rotates and to press the cloth-like member into the surface of the cymbal 40. As the cymbal 40 continues to rotate, the cloth-like member will remove the residue of the cleaning agent and, in the process, the dirt and grease from the cymbal 40.

To better simplify and expedite the process, it is best that the cloth-like member be dampened and, if necessary, a second or third or more such cloth-like members be used. These steps may be repeated as necessary until the cymbal 40 is clean and shiny.

The cleaning device 10 of the present disclosure need not be used to incorporate this unique method of cleaning a cymbal. Any means of securing a cymbal [to any rotatable object such as, but not limited to, a turntable] and rotating the cymbal will produce an equivalent result if the method steps disclosed herein are followed.

The present disclosure includes that contained in the present claims as well as that of the foregoing description. Although this method and device of the present disclosure has been described in its preferred forms with a certain degree of particularity, it is understood that the present disclosure of the preferred form has been made only by way of example and numerous changes in the details of construction and combination and arrangement of parts and method steps may be resorted to without departing from the spirit and scope of the method and device of the present disclosure. Accordingly, the scope of the method and device of the present disclosure should be determined not by the embodiment[s] illustrated, but by the appended claims and their legal equivalents.

Applicant[s] have attempted to disclose all the embodiment[s] of the method and device of the present disclosure that could be reasonably foreseen. It must be understood, however, that there may be unforeseeable insubstantial modifications to method and device of the present disclosure that remain as equivalents and thereby falling within the scope of the method and device of the present disclosure.

What is claimed is:

1. A device for cleaning a cymbal comprising:

a housing having a floor, a wall extending upward from the floor, the wall having a top edge, the housing defining a cavity therein sufficiently sized to receive a cymbal therein, the top edge defining a top opening for inserting the cymbal therethrough;

a rotatable support disposed within the housing configured to secure the cymbal and to spin the cymbal about an axis of rotation, the rotatable support configured such that the cymbal is disposed within the cavity of the housing, below the top edge, when in use;

an upstanding threaded spindle at the upper end of the rotatable support;

a correspondingly threaded fastening member configured to mate with the threaded spindle for securing the cymbal thereto;

a lower set member configured to be disposed on the threaded spindle below the cymbal;

a cushion-like seat member configured to be disposed on the threaded spindle between the lower set member and the cymbal;

an upper set member configured to be disposed on the threaded spindle above the cymbal and below the threaded fastening member; and a motor assembly coupled to the rotatable support configured to rotate the cymbal in a controlled manner, providing variable speed control.

2. A cleaning device as defined in claim 1, wherein the motor assembly includes an electric motor coupled to the rotatable support.

3. A cleaning device as defined in claim 2, wherein the motor assembly further includes a regulator configured to enable a user to control the speed of rotation of the cymbal.

4. A device for cleaning a cymbal, comprising:

a housing having a floor, a wall extending upward from the floor, the wall having a top edge, the housing defining a cavity therein sufficiently sized to receive a cymbal therein, the top edge defining a top opening for inserting the cymbal therethrough;

a rotatable support disposed within the housing configured to secure the cymbal and to spin the cymbal about an axis of rotation, the rotatable support configured such that the cymbal is disposed within the cavity of the housing, below the top edge, when in use;

a motor assembly coupled to the rotatable support configured to rotate the cymbal in a controlled manner, providing variable speed control;

a cleaning agent for cleaning the cymbal, and a handheld abrasive member sized to be used by an operator to interact with the cleaning agent on the cymbal and to be translated radially over the cymbal from approximately a central axis to approximately an outer edge of the cymbal.

5. A device for cleaning a cymbal comprising:

a cylindrical housing having a floor, a cylindrical wall extending upward from the floor and having a circular top edge, the housing defining a cavity therein sufficiently sized to receive a cymbal therein, the top edge of the housing defining a circular top opening for inserting the cymbal therethrough;

a rotatable support disposed within the housing configured to secure the cymbal and to spin the cymbal about an axis of rotation, the rotatable support mount positioned such that the cymbal is disposed within the cavity of the housing, below the top edge, when in use, the rotatable support including, an upstanding threaded spindle at the upper end of the rotatable support for receiving the cymbal through a central aperture of the cymbal, a cushion-like seat member configured to be disposed on the treaded spindle below the cymbal, and a threaded fastening member configured to mate with the threaded spindle above the cymbal for securing the cymbal thereto;

a motor assembly coupled to the rotatable support configured to rotate the cymbal in a controlled manner; wherein the top opening is sized so that as the cymbal an operator can reach through the top opening of the housing to apply a cleaning agent to the cymbal, and afterwhich the operator can apply an abrasive member radially over the cymbal from approximately a central axis to approximately an outer edge of the cymbal;

a cleaning agent for cleaning the cymbal;

a handheld abrasive member configured to be used by an operator to interact with the cleaning agent on the cymbal and to be translated radially over the cymbal from approximately a central axis to approximately an outer edge of the cymbal; and a handheld cloth-like member configured to be used by an operator to be translated radially over the cymbal from approximately a central axis to approximately an outer edge of the cymbal to remove residue from the cymbal.

6. A cleaning device as defined in claim 5, wherein the support member includes a beveled portion configured to support the cushion-like seat member.

7. A cleaning device as defined in claim 5, wherein the motor assembly includes an electric motor coupled to the rotatable support.

8. A cleaning device as defined in claim 7, wherein the motor assembly further includes a regulator configured to enable a user to control the speed of rotation of the cymbal.

9. A cleaning device as defined in claim 4, wherein the support member includes a beveled portion configured to support the cushion-like seat member.

10. A cleaning device as defined in claim 4, wherein the motor assembly includes an electric motor coupled to the rotatable support.

11. A cleaning device as defined in claim 10, wherein the motor assembly further includes a regulator configured to enable a user to control the speed of rotation of the cymbal, in use.

* * * * *